US006390028B1

(12) United States Patent
Langmead et al.

(10) Patent No.: US 6,390,028 B1
(45) Date of Patent: May 21, 2002

(54) FUEL-FIRED LIQUID HEATING APPLIANCE WITH BURNER SHUT-OFF SYSTEM

(75) Inventors: John P. Langmead, Reston, VA (US); Jacob H. Hall, Montgomery, AL (US); Larry D. Kidd, Nashville, MI (US)

(73) Assignee: The Water Heater Industry Joint Research and Development Consortium, Reston, VA (US)

( * ) Notice: Subject to any disclaimer, the term of this patent is extended or adjusted under 35 U.S.C. 154(b) by 0 days.

(21) Appl. No.: 09/804,555

(22) Filed: Mar. 12, 2001

(51) Int. Cl.[7] ..... F22B 5/04
(52) U.S. Cl. ..... 122/14.2; 122/14.21
(58) Field of Search ..... 122/13.01, 14.31, 122/14.2, 14.21, 504

(56) References Cited

U.S. PATENT DOCUMENTS

| | | | | |
|---|---|---|---|---|
| 5,697,330 A | * | 12/1997 | Yetman et al. | 122/13.1 |
| 6,295,951 B1 | * | 10/2001 | Valcic et al. | 122/14.2 |
| 2001/0038986 A1 | | 11/2001 | Abraham et al. | 431/22 |

* cited by examiner

*Primary Examiner*—Gregory Wilson
(74) *Attorney, Agent, or Firm*—Konneker & Smith, P.C.

(57) ABSTRACT

A fuel-fired heating appliance, representatively a gas-fired water heater, has a combustion chamber in a lower end portion thereof, and fuel burner apparatus having main and pilot burner portions is operatively disposed in the combustion chamber. During operation of the water heater combustion air is supplied to the burner apparatus only via a duct structure having an inlet elevated relative to the floor or other horizontal support surface upon which the water heater rests. A flammable vapor sensor is mounted on the lower end portion of the water heater, externally of the combustion air supply duct structure and at an elevation lower than that of its elevated inlet, and is operatively connected to burner control circuitry which, in turn, is coupled to the burner apparatus. In the event flammable vapors are generated near the floor adjacent the water heater, the vapor sensor operates to detect such vapors and responsively disables the burner apparatus via the control circuitry. The difference in elevation between the vapor sensor and the elevated combustion air inlet gives the sensor additional time to detect and respond to flammable vapors before they upwardly reach the elevated combustion air inlet.

37 Claims, 1 Drawing Sheet

FUEL-FIRED LIQUID HEATING APPLIANCE WITH BURNER SHUT-OFF SYSTEM

BACKGROUND OF THE INVENTION

The present invention generally relates to fuel-fired heating appliances, such as water heaters and, in a preferred embodiment thereof, more particularly relates to a gas-fired water heater having incorporated therein a specially designed flammable vapor sensor-based burner shut-off system.

Gas-fired residential and commercial water heaters are generally formed to include a vertical cylindrical water storage tank with a gas burner structure, typically comprising a main burner and an associated pilot burner, disposed in a combustion chamber below the tank. The burner is supplied with a fuel gas through a gas supply line, and combustion air through one or more air inlet passages providing communication between ambient air and the interior of the combustion chamber.

Water heaters of this general type are extremely safe in operation. However, when gasoline or other flammable liquids are stored or used improperly in proximity to the water heater, there may exist a possibility of flammable vapors becoming entrained in the air intake of the water heater. It is theorized that such vapors might cause secondary combustion to occur within the confines of the water heater combustion chamber. It is accordingly possible for the resulting flame to propagate out of the combustion chamber into the ambient environment around the water heater as a result of following the intake path of the flammable vapor.

In view of this, various modern gas-fired water heater designs, as well as the designs of other types of fuel-fired heating appliances, focus upon the inhibition and/or control of the entrance of flammable vapors into a combustion chamber of the appliance. It is to this design goal that the present invention is directed.

SUMMARY OF THE INVENTION

In carrying out principles of the present invention, in accordance with a preferred embodiment thereof, fuel-fired heating apparatus, representatively a gas-fired water heater, is provided with a specially designed flammable vapor sensor-based burner shutoff system.

A gas-fired water heater illustratively embodying principles of the present invention may be either a power vented or natural draft type and is restable on a horizontal support surface such as a floor. In a representative preferred embodiment thereof, the gas-fired water heater includes a tank adapted to hold a quantity of water, a combustion chamber disposed beneath the tank, and a flue communicated with the interior of the combustion chamber and extending upwardly through the interior of the tank. A gas burner and an associated pilot device are disposed within the combustion chamber, with the burner being operable to receive gas from a source thereof and combust a gas/air mixture within the combustion chamber. A control system is provided and is operable to disable the burner and associated pilot device in response to receipt of a shutdown signal.

A combustion air inlet passage is provided and is operative to deliver combustion air to the combustion chamber. The combustion air inlet passage has an inlet portion exposed to ambient air adjacent the gas fired water heater, and combustion air is deliverable to the combustion chamber only via such inlet portion and through the combustion air inlet passage.

Also incorporated in the gas-fired water heater is a flammable vapor sensor which is disposed externally of the combustion air inlet passage, at an elevation lower than that of its inlet portion, and being operative to sense flammable vapor, illustratively hydrocarbon fumes, and responsively transmit the shutdown signal to the control system which, in turn, operates to disable the burner and associated pilot device.

The elevation of the combustion air passage inlet portion relative to the flammable vapor sensor uniquely creates a time delay between the time at which the sensor is exposed to flammable vapor created at floor level by, for example a spill of flammable liquid adjacent the water heater, and the time at which flammable vapor reaches the elevated combustion air passage inlet portion to enable the flammable vapor to traverse the combustion air passage and enter the combustion chamber. This time delay gives the sensor, and the associated burner control system, additional time to sense the flammable vapor and disable the burner and pilot device before a combustible concentration of flammable vapors enters the combustion chamber.

Illustratively, the combustion chamber has a perforated bottom side wall portion with openings therein through which combustion air may enter the combustion chamber. The openings are preferably spaced and configured to (1) allow combustion air to flow upwardly through the openings with a pressure drop which is sufficiently low so as to not materially impede the combustion process of the water heater, and (2) act as flame arresting passages that hinder a downward flow of flames through the openings in the event that flammable vapor passes upwardly through the openings into the combustion chamber are ignited within the combustion chamber.

In an illustrated preferred embodiment of the gas-fired water heater, the combustion air passage is at least partially defined by an external wall structure having a vertical portion in which the elevated combustion air passage inlet portion is formed, and a horizontal portion extending beneath the combustion chamber and having an interior communicated with the interior of the combustion chamber. As will be readily appreciated by those of skill in this particular art, however, a variety of other techniques could alternatively be employed to elevate the water heater's combustion air intake location relative to the flammable vapor sensor to provide a time delay between the sensor's exposure to flammable vapors and potential entry of such flammable vapors into the combustion chamber.

While principles of the present invention are illustrated herein as being representatively incorporated in a fuel-fired water heater, it will be readily appreciated by those of ordinary skill in this particular art that such principles are not limited to a water heater, but could be alternatively incorporated to advantage in a variety of other types of fuel-fired heating appliances including, but not limited to, boilers and air heating furnaces.

DETAILED DESCRIPTION

Figure 1:
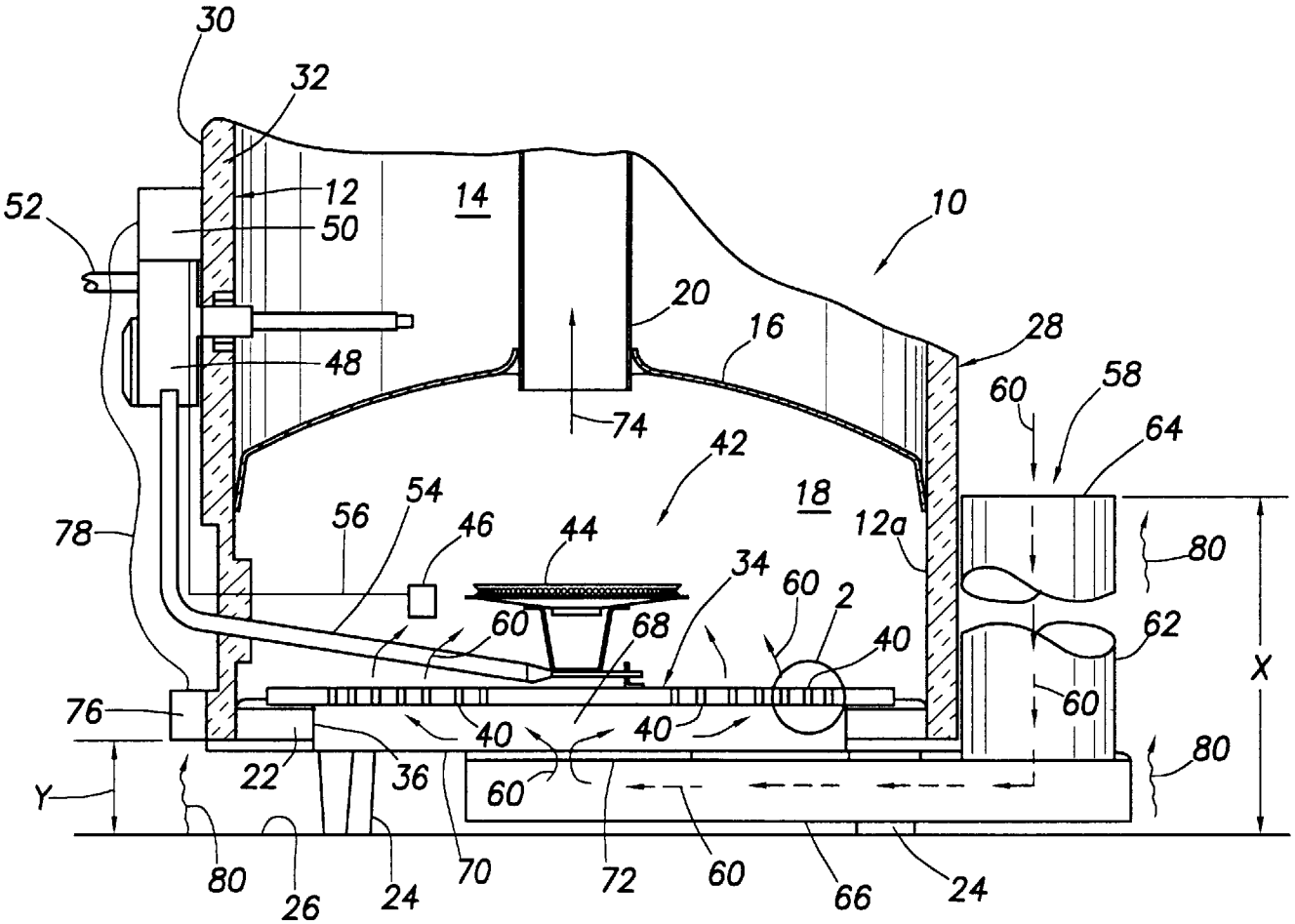
FIG. 1 is a simplified, somewhat schematic cross-sectional view, partly in elevation, through a bottom end portion of a gas-fired water heater incorporating therein a specially designed burner shut-off system embodying principles of the present invention.

Cross-sectionally illustrated in simplified form in FIG. 1 is a lower end portion of a specially designed fuel-fired water heater 10 embodying principles of the present invention. Illustratively, the fuel-fired water heater 10 is a gas-fired water heater, utilizing natural or liquefied petroleum gas, but could alternatively be an oil-fired water heater. Water heater 10 has a vertically oriented cylindrical metal water storage tank 12 in which a quantity of heated water 14 is stored, the tank 12 having an upwardly domed bottom head portion 16 that defines the upper wall of a combustion chamber 18 which communicates with the open lower end of a combustion flue tube 20 that centrally extends upwardly through the interior of the tank 12. An annular outer side wall portion of the combustion chamber 18 is defined by an annular lower end portion 12*a* of the tank which extends downwardly past the periphery of the bottom head portion 16. In a conventional manner suitable outlet and inlet pipes (not shown) are connected to the tank 12 to respectively flow heated water out of the tank and flow water to be heated into the tank.

The open lower end portion 12*a* of the tank 12 is partially closed by an annular bottom wall structure 22 which is sealingly received and suitably anchored within a peripheral section of the bottom tank end portion 12*a*. Circumferentially spaced support legs 24 extend downwardly from the annular bottom wall 22 and are restable on a horizontal support surface, such as the illustrated floor 26, to position the bottom wall 22 in an elevated relationship with the floor 26.

Outwardly circumscribing the tank 12 is a cylindrical insulating jacket structure 28 having an annular outer metal jacket portion 30 which is coaxial with the tank 12 and spaced outwardly therefrom. A suitable insulation material, such as foam insulation 32, is disposed within the annular space between the metal jacket portion 30 and the tank 12.

Figure 2:
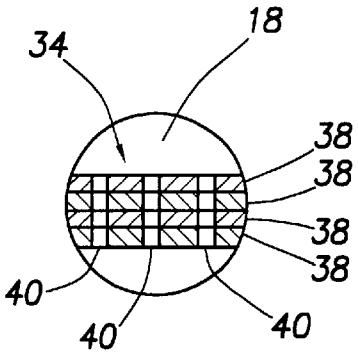
FIG. 2 is an enlarged cross-sectional detail view of the circled area "2" in FIG. 1.

A circular perforated plate structure 34 is sealingly placed atop the annular bottom wall 22 at the bottom side of the combustion chamber and extends across and covers the circular central opening 36 in the bottom wall 22. Representatively, the plate structure 34 is formed from a stacked plurality of disc-shaped metal plates 38 (representatively four in number as illustrated in FIG. 2), with the perforations in the individual plates 38 being in registry with one another to combinatively define a spaced series Of vertical combustion chamber air intake openings 40 vertically extending from the bottom side of the plate structure 34 to its top side. The illustrated openings have circular cross-sections along their lengths, but could alternatively have other cross-sectional configurations. While the plate structure 34 is representatively formed from a stacked plurality Of representatively four individual perforated metal plates, it will be appreciated that if desired it could be alternatively formed from a greater or lesser number of plates, including a single plate.

The water heater 10 is representatively of a power vented type in which a conventional draft inducer fan (not shown) is operatively associated with the flue tube 20 to collect and propel to the outdoors combustion products passing upwardly through the flue tube during firing of the water heater 10 as later described herein. Alternatively, however, the water heater 10 could be a natural draft water heater which is operable without such a draft inducer fan.

Fuel burning apparatus 42 is operatively supported within the interior of the combustion chamber 18 and includes a main gas burner 44 and an associated intermittent pilot device, representatively a schematically depicted spark ignition device 46. A thermostatic gas supply valve 48, which monitors the temperature of the stored water 14 and correspondingly controls the firing of the burner 44, to maintain a predetermined tank water temperature, is externally mounted on the outer side of the jacket structure 28 on the left side of the water heater 10 as viewed in FIG. 1. Schematically depicted burner system control circuitry 50 is operatively associated with the thermostatic gas supply valve 48 and functions as subsequently described herein. Thermostatic valve 48 receives a supply of gaseous fuel through a gas pipe 52 and is coupled to the main burner 44 by a gas supply pipe 54. The pilot device 46 is electrically coupled to the control circuitry 50 via lead 56.

A combustion air intake duct structure 58 is associated with the balance of the water heater 10, to supply combustion air 60 to the combustion chamber 18 as later described herein, and representatively includes a vertically oriented duct section 62 disposed externally adjacent the water heater jacket structure 28 and having an open upper inlet end 64 elevated relative to the floor 26 by a vertical distance X which representatively may range from about 6 inches to about 20 inches, but may be a greater or lesser dimension if necessary or desired.

At its lower end the vertical duct section 62 is connected to a horizontal duct section 66 that, from its juncture with the bottom end of the vertical duct section 62, extends leftwardly beneath the annular bottom wall structure 22. The overall duct structure 58 also includes a circular plenum structure 68, having a bottom wall 70 and an open top side, which is sealingly disposed within the central opening 36 of the annular bottom wall structure 22, with the interior of the plenum structure 68 being communicated with the interior of a left end portion of the horizontal duct section 66 by, for example, a connecting duct structure 72 interconnecting the bottom plenum wall 70 and the horizontal duct section 66.

Upon a call from the thermostatic valve 48 for heat to be added to the water 14 stored in the tank 12, fuel is supplied to the burner 44, mixed with ambient combustion air 60 delivered to the combustion chamber 18 as later described herein, and (in response to operation of the pilot device 46) combusted by the burner 44 to form hot combustion products 74 which travel upwardly through the flue tube 20. During firing of the water heater 10, ambient combustion air 60 is drawn into the combustion chamber 18 sequentially via the open upper duct inlet end 64, the ducts 62,66,72, the plenum 68, and the air intake openings 40 in the perforated plate structure 34. It is important to note that this path is the sole flow path for combustion air 60 entering the combustion chamber 18. In other words, all combustion air 60 delivered to the combustion chamber 18 must initially enter the elevated inlet opening 64.

The water heater 10 also includes a flammable vapor sensor 76 externally mounted on a lower end portion of the jacket structure 28 and operatively coupled to the burner system control circuitry 50 via an electrical lead 78. Sensor 76 is of a conventional type operative to detect flammable vapor 80 created at the floor 26 by, for example, a spill of a flammable liquid near the water heater 10, and responsively output a signal indicative of the sensing of such flammable vapor. Representatively, the sensor 76 is operative to sense hydrocarbon vapors and is of a type manufactured and marketed by Adsistor Technology, Inc. of Seattle, Wash.

As indicated in FIG. 1, the flammable vapor sensor 76 is supported at a distance Y above the floor 26 which is less than the vertical distance X between the floor 26 and the elevated open inlet end 64 of the vertical combustion air intake duct 62. In the event that flammable vapor 80 is caused to emanate from floor level adjacent the water heater 10, a portion of the flammable vapor 80 will contact the sensor 76 and activate it. Activation of the sensor 76 will, in turn, generate a burner system shutdown signal which is transmitted to the burner system control circuitry 50 via the lead 78. upon receiving this sensor-generated shutdown signal, the circuitry 50 automatically functions to disable both the main burner 44 and its associated pilot device 46. If the burner 44 is operating when the shutdown signal is generated by the sensor 76, the thermostatic valve 48 is caused to terminate gas flow to the burner 44 via the gas supply pipe 54, and the pilot device 46 is electrically disabled. If, on the other hand, the water heater 10 is in a standby mode when the shutdown signal is generated by the sensor 76, subsequent burner gas delivery via the pipe 54, and subsequent sparking of the pilot device 46, are prevented by the burner system control circuitry 50.

According to a key aspect of the present invention, the schematically illustrated difference in height between the higher combustion air duct inlet opening 64 and the lower flammable vapor sensor 76 uniquely creates a built-in time delay between (1) the time that flammable vapor 80 emanating from the floor 26 adjacent the water heater 10 and comes into contact with the sensor 76, and (2) the time when the vapor 80 enters the combustion chamber 18 by sequentially rising to the level of the elevated combustion air intake opening 64, traversing the intake ductwork system 62,66, 72,68 and passing upwardly through the perforated plate structure openings 40. This sensor/intake height differential thus desirably gives the above described flammable vapor sensor-based burner shutoff system more time to react to the presence of flammable vapors 80 near floor level adjacent the water heater 10.

While a single flammable vapor sensor 76 has been illustrated, it will readily be appreciated that more than one sensor 76 could be utilized in the described burner shutoff system if desired. For example, a series of sensors 76 could be circumferentially spaced around the water heater near floor level. Additionally, the illustrated sensor 76 (and additional sensors, if used) could be vertically positioned somewhat lower or higher than the illustrated sensor 76 if desired.

Although the illustrated water heater 10 has been described as being a power vented water heater, it will be readily appreciated by those of skill in this particular art that a natural draft water heater could also be advantageously provided with the described burner shutoff system. In this case, the natural draft water heater might have a standing flame pilot device (instead of the illustrated intermittent spark type pilot device 46) which was supplied with gas via a pilot gas supply line operatively coupled to the thermostatic gas valve 48. If flammable vapor 80 was detected by the sensor 76, the burner system control circuitry 50 could be utilized to responsively disable both the main burner and pilot burner by causing the thermostatic valve 48 to preclude further gas flow thereto.

Preferably, the previously described perforated plate structure 34 extending along the bottom side of the combustion chamber 18 is similar in construction to the perforated combustion chamber plate structure 48 illustrated and described in U.S. Pat. No. 5,941,202, which is hereby incorporated herein by reference, in that the spacing and configuration of the vertical plate structure openings 40 are selected to cause the openings 40 to (1) allow the combustion air 60 to flow upwardly through the openings 40 with a pressure drop which is sufficiently low so as to not materially impede the normal combustion process of the fuel-fired water heater 10, while at the same time (2) act as flame arresting passages that hinder a downward flow of flames through the openings 40 in the event that flammable vapor 80 passing upwardly through the openings 40 are ignited within the combustion chamber 18.

To provide the combustion air inlet openings 40, which representatively have circular cross-sections, with these two characteristics, their hydraulic or effective diameters and their passage lengths are selected in a manner such that upward air inlet flow through the openings 40 can occur with minimal pressure drop, but the openings 40 act to decrease downward flame propagation velocity therethrough in a manner extracting sufficient heat from such downwardly directed flames to quench them before they downwardly exit the openings 40. In this manner, downward flame outflow through the bottom ends of the openings 40, caused by ignition within the combustion chamber 18 of flammable vapor 80 upwardly entering the combustion chamber through the openings 40, is hindered to thereby reduce the possibility of such ignition being spread to flammable vapor 80 externally adjacent the water heater 10. Further details relating to the operation and representative sizing and spacing of the plate openings 40 may be found in the aforementioned U.S. Pat. No. 5,941,200 incorporated by reference herein.

While the flammable vapor sensor-based burner shutoff system of the present invention has been representatively illustrated and described herein as being incorporated in a fuel-fired water heater, it will be readily appreciated that it could alternatively be incorporated in a variety of other fuel-fired heating appliances, including but not limited to boilers and other fuel-fired heating devices such as fuel-fired heating furnaces, as well without departing from the principles of the present invention.

Additionally, while the water heater 10 has been representatively illustrated as being provided with the elevated external combustion air intake duct structure 58 to provide a time delay between the exposure of the sensor 76 to flammable vapor 80 and the potential entry of flammable vapor 80 into the combustion chamber 18, those of skill in this particular art will appreciate that other techniques could be employed to elevate the water heater's combustion air intake location by the representative distance of from about six inches to about twenty inches relative to the flammable vapor sensor. For example, the external ductwork structure 58 could be eliminated, the sensor 76 could be disposed closely adjacent the floor 26, and the support legs 24 vertically lengthened to elevate the plate structure 34 above the floor by the representative distance of from about six inches to about twenty inches.

The foregoing detailed description is to be clearly understood as being given by way of illustration and example only, the spirit and scope of the present invention being limited solely by the appended claims.

What is claimed is:

1. Fuel-fired liquid heating apparatus comprising:

a storage tank adapted to hold liquid to be heated and having a bottom portion;

a combustion chamber positioned beneath said bottom portion;

fuel burning apparatus operative to combust fuel and combustion air supplied thereto from sources thereof and create hot combustion products within said combustion chamber;

a control system operative to shut down said fuel burning apparatus in response to receipt of a shutdown signal;

a flue extending through the interior of said storage tank and communicating with the interior of said combustion chamber;

a combustion air inlet passage for delivering combustion air to said fuel burning apparatus and having an inlet portion exposed to ambient air adjacent said fuel-fired liquid heating apparatus, combustion air being deliverable to said fuel burning apparatus only via said inlet portion and through said combustion air inlet passage; and a sensor disposed externally of said combustion air inlet passage, at an elevation lower than that of said inlet portion, and being operative to sense flammable vapor and responsively transmit said shutdown signal to said control system.

2. The fuel-fired liquid heating apparatus of claim 1 wherein said fuel-fired liquid heating apparatus is a fuel-fired water heater.

3. The fuel-fired liquid heating apparatus of claim 2 wherein said water heater is a gas-fired water heater.

4. The fuel-fired liquid heating apparatus of claim 2 wherein said fuel-fired water heater is a power vented water heater.

5. The fuel-fired liquid heating apparatus of claim 2 wherein said fuel-fired water heater is a natural draft water heater.

6. The fuel-fired liquid heating apparatus of claim 1 wherein said sensor is operative to sense hydrocarbon vapors.

7. The fuel-fired liquid heating apparatus of claim 1 wherein said combustion chamber has a perforated bottom side wall portion with openings therein through which combustion air may enter said combustion chamber.

8. The fuel-fired liquid heating apparatus of claim 7 wherein said openings are spaced and configured to (1) allow combustion air to flow upwardly through the openings with a pressure drop which is sufficiently low so as to not materially impede the combustion process of the fuel-fired liquid heating apparatus, and (2) act as flame arresting passages that hinder a downward flow of flames through the openings in the event that flammable vapor passing upwardly through the openings into the combustion chamber are ignited within the combustion chamber.

9. The fuel-fired liquid heating apparatus of claim 1 wherein said combustion air inlet passage is at least partially defined by an external wall structure having a vertical portion in which said inlet portion is disposed, and a horizontal portion extending beneath said combustion chamber and having an interior communicated with the interior of said combustion chamber.

10. The fuel-fired liquid heating apparatus of claim 9 wherein:

said fuel-fired liquid heating apparatus has a lower end portion, said sensor is mounted on said lower end portion, and said inlet portion is elevated relative to said sensor.

11. A gas-fired water heater comprising:

a tank adapted to hold a quantity of water;

a combustion chamber disposed beneath said tank;

a flue communicated with the interior of said combustion chamber and extending upwardly through the interior of said tank;

a gas burner disposed within said combustion chamber and operable to receive gas from a source thereof and combust a gas/air mixture within said combustion chamber;

a pilot device disposed within said combustion chamber and operatively associated with said gas burner;

a control system operative to disable said gas burner and said pilot device in response to receipt of a shutdown signal;

a combustion air inlet passage operative to deliver combustion air to said combustion chamber and having an inlet portion exposed to ambient air adjacent said gas-fired water heater, combustion air being deliverable to said combustion chamber only via said inlet portion and through said combustion air inlet passage; and a flammable vapor sensor disposed externally of said combustion air inlet passage, at an elevation lower than that of said inlet portion, and being operative to sense flammable vapor and responsively transmit said shutdown signal to said control system.

12. The gas-fired water heater of claim 11 wherein said gas-fired water heater is a power vented gas-fired water heater.

13. The gas-fired water heater of claim 11 wherein said gas-fired water heater is a natural draft gas-fired water heater.

14. The gas-fired water heater of claim 11 wherein said flammable vapor sensor is operative to sense hydrocarbon vapors.

15. The gas-fired water heater of claim 11 wherein said combustion chamber has a perforated bottom side wall portion with openings therein through which combustion air may enter said combustion chamber.

16. The gas-fired water heater of claim 15 wherein said openings are spaced and configured to (1) allow combustion air to flow upwardly through the openings with a pressure drop which is sufficiently low so as to not materially impede the combustion process of the gas-fired water heater, and (2) act as flame arresting passages that hinder a downward flow of flames through the openings in the event that flammable vapor passing upwardly through the openings into the combustion chamber are ignited within the combustion chamber.

17. The gas-fired water heater of claim 11 wherein said combustion air inlet passage is at least partially defined by an external wall structure having a vertical portion in which said inlet portion is disposed, and a horizontal portion extending beneath said combustion chamber and having an interior communicated with the interior of said combustion chamber.

18. The gas-fired water heater of claim 17 wherein:

said fuel-fired liquid heating apparatus has a lower end portion, said flammable vapor sensor is mounted on said lower end portion, and said inlet portion is elevated relative to said flammable vapor sensor.

19. For use in conjunction with a fuel-fired heating device having a combustion chamber to which combustion air may be supplied, and fuel burning apparatus operative to combust fuel and combustion air supplied thereto from sources thereof and create hot combustion products in said combustion chamber, a method of inhibiting entry of flammable vapor into said combustion chamber, said method comprising the steps of:

permitting delivery of combustion air to said combustion chamber only via a flow path having an inlet portion;

disposing a flammable vapor sensor adjacent the device, said flammable vapor sensor being external to said flow path and useable to disable operation of said fuel burning apparatus in response to being exposed to flammable vapor; and creating a time delay between the detection of flammable vapor by said sensor and entry of flammable vapor into said flow path by elevating said inlet portion relative to said flammable vapor sensor.

20. The method of claim 19 wherein said disposing step is performed using a flammable vapor sensor operative to detect hydrocarbon vapor.

21. For use in conjunction with a fuel-fired heating device having a combustion chamber positioned at a lower portion thereof, and fuel burning apparatus operative to combust fuel and combustion air supplied thereto from sources thereof and create hot combustion products within said combustion chamber, a method of inhibiting entry of flammable vapor into said combustion chamber, said method comprising the steps of:

supporting said fuel-fired heating device on a horizontal surface with said combustion chamber being elevated relative to the horizontal surface by a distance in the range of from about six inches to about twenty inches; and disposing a flammable vapor sensor exteriorly adjacent said heating device and substantially at the level of the horizontal surface, the sensor being operative to detect flammable vapor and responsively terminate operation of said fuel burning apparatus.

22. The method of claim 21 wherein said supporting step is performed in a manner such that said combustion chamber is elevated relative to the horizontal surface by a distance of about eighteen inches.

23. Fuel-fired heating apparatus comprising:

a combustion chamber;

fuel burning apparatus operative to combust fuel and combustion air supplied thereto from sources thereof and create hot combustion products within said combustion chamber;

a control system operative to shut down said fuel burning apparatus in response to receipt of a shutdown signal;

a combustion air inlet passage for delivering combustion air to said fuel burning apparatus and having an inlet portion exposed to a source of combustion air, combustion air being deliverable to said fuel burning apparatus only via said inlet portion and through said combustion air inlet passage; and a sensor disposed externally of said combustion air inlet passage, at an elevation lower than that of said inlet portion, and being operative to sense flammable vapor and responsively transmit said shutdown signal to said control system.

24. The fuel-fired heating apparatus of claim 23 wherein said fuel-fired heating apparatus is a fuel-fired water heater.

25. The fuel-fired heating apparatus of claim 24 wherein said water heater is a gas-fired water heater.

26. The fuel-fired heating apparatus of claim 24 wherein said fuel-fired water heater is a power vented water heater.

27. The fuel-fired heating apparatus of claim 24 wherein said fuel-fired water heater is a natural draft water heater.

28. The fuel-fired heating apparatus of claim 23 wherein said sensor is operative to sense hydrocarbon vapors.

29. The fuel-fired heating apparatus of claim 23 wherein said combustion chamber has a perforated bottom side wall portion with openings therein through which combustion air may enter said combustion chamber.

30. The fuel-fired heating apparatus of claim 29 wherein said openings are spaced and configured to (1) allow combustion air to flow upwardly through the openings with a pressure drop which is sufficiently low so as to not materially impede the combustion process of the fuel-fired liquid heating apparatus, and (2) act as flame arresting passages that hinder a downward flow of flames through the openings in the event that flammable vapor passing upwardly through the openings into the combustion chamber are ignited within the combustion chamber.

31. The fuel-fired heating apparatus of claim 23 wherein said combustion air inlet passage is at least partially defined by an external wall structure having a vertical portion in which inlet portion is disposed, and a horizontal portion extending beneath said combustion chamber and having an interior communicated with the interior of said combustion chamber.

32. The fuel-fired heating apparatus of claim 31 wherein:

said fuel-fired heating apparatus has a lower end portion, said sensor is mounted on said lower end portion, and said inlet portion is elevated relative to said sensor.

33. Fuel-fired heating apparatus comprising:

a fuel-fired heating appliance having a lower portion in which a combustion chamber is disposed, said combustion chamber having fuel burning apparatus operatively associated therewith, and a combustion air inlet opening; and an unenclosed flammable vapor sensor disposed substantially at said horizontal surface, coupled to said fuel-fired heating appliance, and operative to shut off said fuel burner apparatus in response to detecting flammable vapor, said combustion air inlet opening being spaced upwardly apart from said flammable vapor sensor.

34. The fuel-fired heating apparatus of claim 33 wherein said combustion air inlet opening is spaced upwardly apart from said flammable vapor sensor by a distance of from about six inches to about twenty inches.

35. The fuel-fired heating appliance of claim 34 wherein said combustion air inlet opening is spaced upwardly apart from said flammable vapor sensor by a distance of approximately eighteen inches.

36. The fuel-fired heating apparatus of claim 33 wherein said fuel-fired heating appliance is a fuel-fired water heater.

37. The fuel-fired heating appliance of claim 36 wherein said fuel-fired water heater is a gas-fired water heater.

* * * * *

UNITED STATES PATENT AND TRADEMARK OFFICE

CERTIFICATE OF CORRECTION

PATENT NO. : 6,390,028 B1 
DATED : May 21, 2002
INVENTOR(S) : John P. Langmead, Jacob H. Hall and Larry D. Kidd It is certified that error appears in the above-identified patent and that said Letters Patent is hereby corrected as shown below:

Title page,
Item [56], References Cited, add the following:

| | | | | |
|---|---|---|---|---|
| -- | 2,345,772A | 4/1944 | Robertson et al. | 177/311 |
| | 3,045,198A | 7/1962 | Dolan et al. | 338/13 |
| | 4,129,030A | 12/1978 | Dolan | 73/23 |
| | 4,134,112A | 1/1979 | Kercheval et al. | 340/632 |
| | 4,224,595A | 9/1980 | Dolan | 338/34 |
| | 4,752,761A | 6/1988 | Dolan et al. | 338/34 |
| | 4,827,246A | 5/1989 | Dolan et al. | 340/521 |
| | 5,085,205A | 2/1992 | Hall et al. | 126/363 |
| | 5,189,392A | 2/1993 | Kass et al. | 340/521 |
| | 5,765,547A | 6/1998 | La Plante. | 126/361 |
| | 5,797,355A | 8/1998 | Bourke et al. | 122/13.1 |
| | 5,797,358A | 8/1998 | Brandt et al. | 122/448.1 |
| | 5,848,586A | 12/1998 | Garms | 126/361 |
| | 5,918,591A | 7/1999 | Vollmar et al. | 126/361 |
| | 5,941,200A | 8/1999 | Boros et al. | 122/13.1 |
| | 5,950,573A | 9/1999 | Schellenberger et al. | 122/448.1 |
| | 6,035,812A | 3/2000 | Harrigill et al. | 122/504 |

OTHER PUBLICATIONS

Adsistor Technology, Inc. Brochure Sheets (2) - Undated.
"Adsistor Vapor Sensor Applications", Adsistor Technology, Inc., dated April 15, 1999 --.

Signed and Sealed this

Twenty-third Day of July, 2002

*Attest:*

*Attesting Officer*

JAMES E. ROGAN
*Director of the United States Patent and Trademark Office*